US010213061B1

(12) United States Patent
Safdie

(10) Patent No.: US 10,213,061 B1
(45) Date of Patent: Feb. 26, 2019

(54) DISPENSER WITH COMPLETE DISPENSING AND CLOSURE

(71) Applicant: Morris Edward Safdie, Brooklyn, NY (US)

(72) Inventor: Morris Edward Safdie, Brooklyn, NY (US)

( * ) Notice: Subject to any disclaimer, the term of this patent is extended or adjusted under 35 U.S.C. 154(b) by 0 days.

(21) Appl. No.: 16/106,317

(22) Filed: Aug. 21, 2018

Related U.S. Application Data

(63) Continuation of application No. 16/056,677, filed on Aug. 7, 2018.

(51) Int. Cl.
*A47K 5/12* (2006.01)
*B05B 11/00* (2006.01)
*B05B 15/30* (2018.01)

(52) U.S. Cl.
CPC ..... *A47K 5/1205* (2013.01); *B05B 11/0064* (2013.01); *B05B 11/307* (2013.01); *B05B 15/30* (2018.02)

(58) Field of Classification Search
CPC ... B05B 11/307; B05B 11/0064; B05B 15/30; A47K 5/1205
USPC ..... 222/321.5, 377, 464.7
See application file for complete search history.

(56) References Cited

U.S. PATENT DOCUMENTS 2,305,286 A * 12/1942 Ward ..... A47J 43/121 215/5
4,759,475 A * 7/1988 Munthe ..... B67D 1/0079 222/464.7
4,979,642 A * 12/1990 Thiebaut ..... A61M 11/00 215/247
5,366,119 A * 11/1994 Kline ..... B05B 15/30 222/180
6,257,446 B1 7/2001 Pike
7,644,841 B2 1/2010 Brainard et al.
2001/0032864 A1 10/2001 Shepherd

* cited by examiner

*Primary Examiner* — Donnell A Long
(74) *Attorney, Agent, or Firm* — Michael J. Feigin, Esq.; Feigin and Fridman LLC

(57) ABSTRACT

A dispenser has a housing with a stem extending through the housing. The stem is attached to a head which rotates therewith. When the stem/head combination are rotated axially into, are in some positions, blocking flanges block portals into the stem. In other axially rotated positions, portals in the stem are unblocked by the portals. The portals are at a side of the stem adjacent to the bottom in embodiments of the disclosed technology. Further, a bottom region of the internal space can be conical to direct the material towards the portals, the bottom side of the stem being surrounded by the adjacent conical space such that it fits snugly there-with in embodiments of the disclosed technology.

16 Claims, 7 Drawing Sheets

DISPENSER WITH COMPLETE DISPENSING AND CLOSURE

BACKGROUND OF THE DISCLOSURE

Dispensers with pumps are typically used to dispense viscous liquid material such as soap, creams, and the like. Any liquid, solid or even gas (under pressure) can be dispensed with a pump dispenser which pulls material from the bottom of a container or housing enclosing an internal space and releases such material to the outside. A problem and frustration with most such dispensers which pump material out is that when reaching the bottom, not all the material can be dispensed. This is because the stem extending into the housing typically does not extend all the way to the bottom or there would be no space between the bottom and stem to suck up the material. This is further because material residing at the bottom spreads along the bottom whereas the stem is only at one position. One has to tip the dispenser or move the stem around to get more material out. This is undesirable and often simply leads to a waste of material at the bottom.

Thus, there is a need to provide a dispenser which can dispense more or all of the contents therein.

SUMMARY OF THE DISCLOSED TECHNOLOGY

A dispenser of an embodiment of the disclosed technology includes a dispensing pathway passing through a head and stem which rotate together. "rotate together", for purposes of this disclosure, is defined as "two structurally different pieces which are mechanically or frictionally arranged such that rotation of the other causes, or is designed to cause, rotation of the other in unison every time one of the two pieces is rotated." A housing has a top portal through which the stem passes into an interior space of the housing. For purposes of this disclosure, directional references refer to how a conventional liquid dispenser with pump is typically used, e.g. with a head and dispensing at the "top" and the container there-below.

The directional references can also refer to the direction of pull of gravity when the device is sitting on a flat surface. That is, the "bottom" is the flat narrower side of the device (at the 'bottom' side of the figures) opposite the side with the head and is closer to the center of the Earth when sitting on a flat surface on the surface thereof. Likewise, "longitudinal" refers to a vertical line extending from the gravitational bottom or bottom, and "latitudinal" or "lateral" refers to a horizontal line or circle around the bottle, the line/circle being equidistant from the bottom or gravitational bottom throughout. Thus, a lateral portal cuts into a lateral side of the stem at a bottom end of the stem. In some embodiments, there are two lateral portals at the bottom end, one on each latitudinal side thereof. The "bottom end" refers to the sides of the stem which are just above and can include the bottom (e.g. open to the bottom).

A blocking flange extends inward from the housing (is joined to and/or forms a unitary piece with the housing). At a first (rotated/rotatable) position of the head and stem, the blocking flange blocks the lateral portal. At a second (rotated/rotatable) position of the head and stem relative to the housing, the head and stem are axially rotated with respect to the first position and the lateral portal is open to the interior space of the housing.

The interior space is made up of (substantially encapsulates a space) which has or substantially has circular cross section with a smaller circumference at a bottom side thereof. The "bottom side" of the housing/interior space is a portion where the internal space is narrower, begins to become narrower, and/or has a cone shaped-interior space within the housing whereas a "top side" thereof is portion which has a continuous cross-sectional area or substantially as such. Said another way, the interior space can be substantially a cylinder joined with a cone.

The blocking flange extends inward from the cylinder and has a vertical side wall which covers the lateral portal in the first position in embodiments of the disclosed technology. A second blocking flange on an opposite latitudinal side of the stem from the (first) blocking flange and a second lateral portal on an opposite latitudinal side of the (first) lateral portal are also used in embodiments of the disclosed technology.

Described another way, a dispenser of embodiments of the disclosed technology has a continuous internal space with a cylindrical region and a conical region. A stem extends through both the cylindrical region and the conical region, the stem fixedly attached to a head. The head is a device which is situated outside of the continuous internal space and can extend horizontally further than the stem. The stem itself has only, exactly, or at least two types of openings. A first type of opening of the step opens into the interior space of the head. A second type opens latitudinally (on the side) adjacent to/aligned with the conical region (where "adjacent" and "aligned with" are defined as having a substantially identical or identical place in two axes on an X, Y, Z plane, e.g. longitudinal or latitudinal to each other and/or are less than 2 centimeters apart). The head and stem are rotatable together and with respect to the continuous internal space and rotation of the stem with respect to the internal space blocks and/or unblocks the at least one opening aligned with the conical region.

At least one opening latitudinally aligned with the conical region is also aligned substantially with a narrowest portion of the conical region of the housing, in an embodiment of the disclosed technology. In some embodiments, flanges extending from a bottom and narrowest portion of the conical region have a medial side (inward, towards a laterally-disposed center of the housing) sized to fit over the at least one opening, the opening being latitudinally aligned with the conical region. The "at least one opening" which is latitudinally aligned with the conical region can be two openings on opposite longitudinal sides of the stem. The bottom side of the stem can be sealed.

Described yet another way, in the same or additional embodiments the dispenser has a housing with internal space adapted for placement of particulate solid and/or liquid material which passes through and out of the dispenser through a stem extending into the internal space. The stem extends through a top side of the housing and abuts a bottom side of the housing as well. Portals on either side of the stem are adjacent to the bottom side of the housing. A head extends at least partially lateral to a most elongated length of the stem. Flanges fixedly connected to the housing and extending into the internal space are sized to block the portals on either side of the stem.

In embodiments of the disclosed technology, the stem and head are rotatable, as a unit, in a transverse direction to the most elongated length of the stem. The flanges block the portals in at least a first rotated position and the portals are open to the internal space in at least a second rotated position in such embodiments. The internal space, in embodiments, becomes progressively narrower along at least a portion of/some of a height thereof with a narrowest width of the internal space being where the flanges are fixedly connected to the housing in embodiments of the disclosed technology. Thus, the internal space can be cone shaped at the progressively narrower portion.

A pathway extends from an exterior of the dispenser through, in order, a transversely extending pathway in a head exterior to the housing followed by a vertical pathway in the stem followed by the internal space of the housing. The flanges can interrupt between the internal space and the stem when the head and the stem are rotated at a specific degree of rotation.

Any device or step to a method described in this disclosure can comprise, or consist of, that which it is a part of, or the parts which make up the device or step. The term "and/or" is inclusive of the items which it joins linguistically, and each item by itself. Any object described can be as described or "substantially" as such wherein "substantially" is defined as "at least 95% true" or "at least 95% of the amount specified."

DETAILED DESCRIPTION OF EMBODIMENTS OF THE DISCLOSED TECHNOLOGY

A dispenser has a housing with a stem extending through the housing. The stem is attached to a head which rotates therewith. When the stem/head combination are rotated axially into, are in some positions, blocking flanges block portals into the stem. In other axially rotated positions, portals in the stem are unblocked by the portals. The portals are at a side of the stem adjacent to the bottom in embodiments of the disclosed technology. Further, a bottom region of the internal space can be conical to direct the material towards the portals, the bottom side of the stem being surrounded by the adjacent conical space such that it fits snugly there-with in embodiments of the disclosed technology.

Embodiments of the disclosed technology should become clearer in view of the following description of the drawings.

Figure 1:
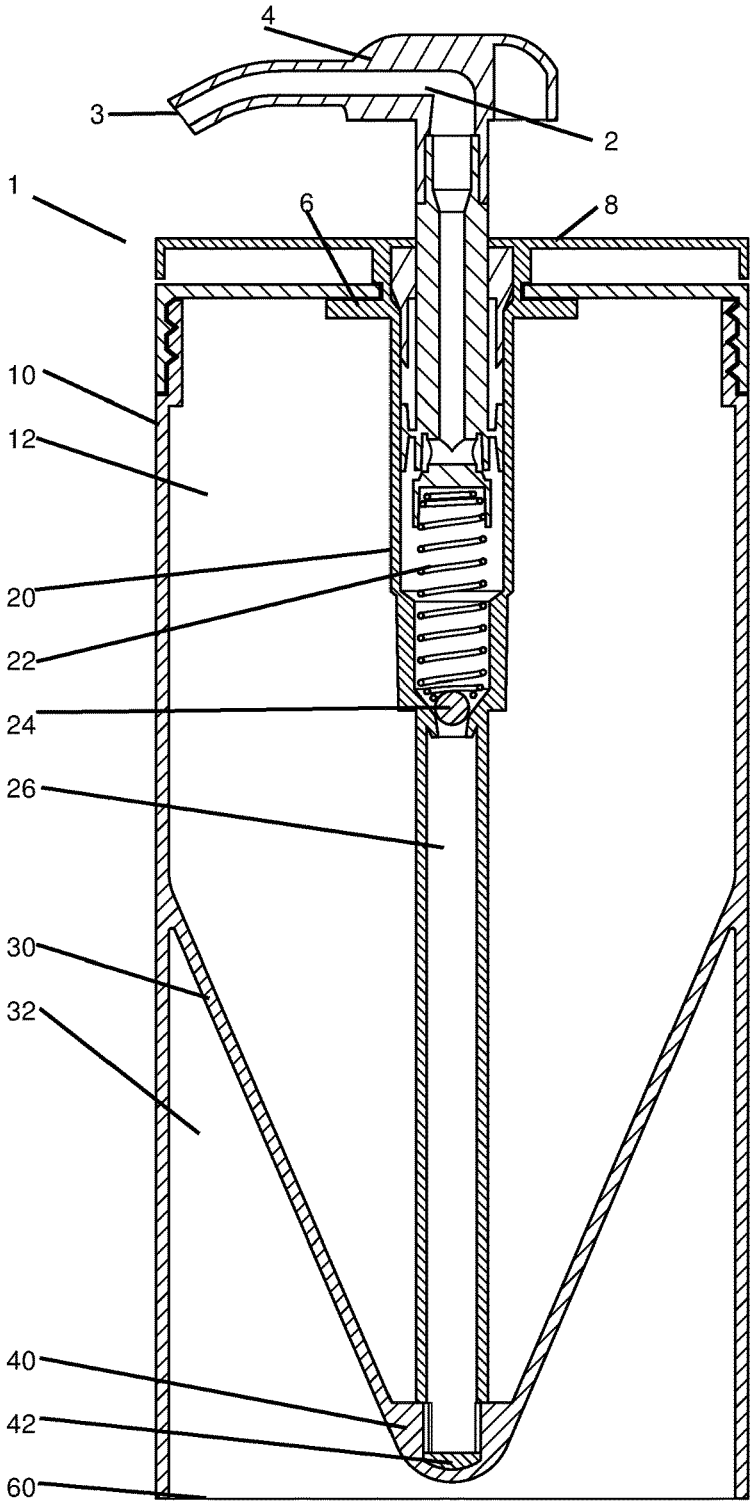
FIG. 1 shows a cutaway elevation view of a dispenser of an embodiment of the disclosed technology.
Figure 2:
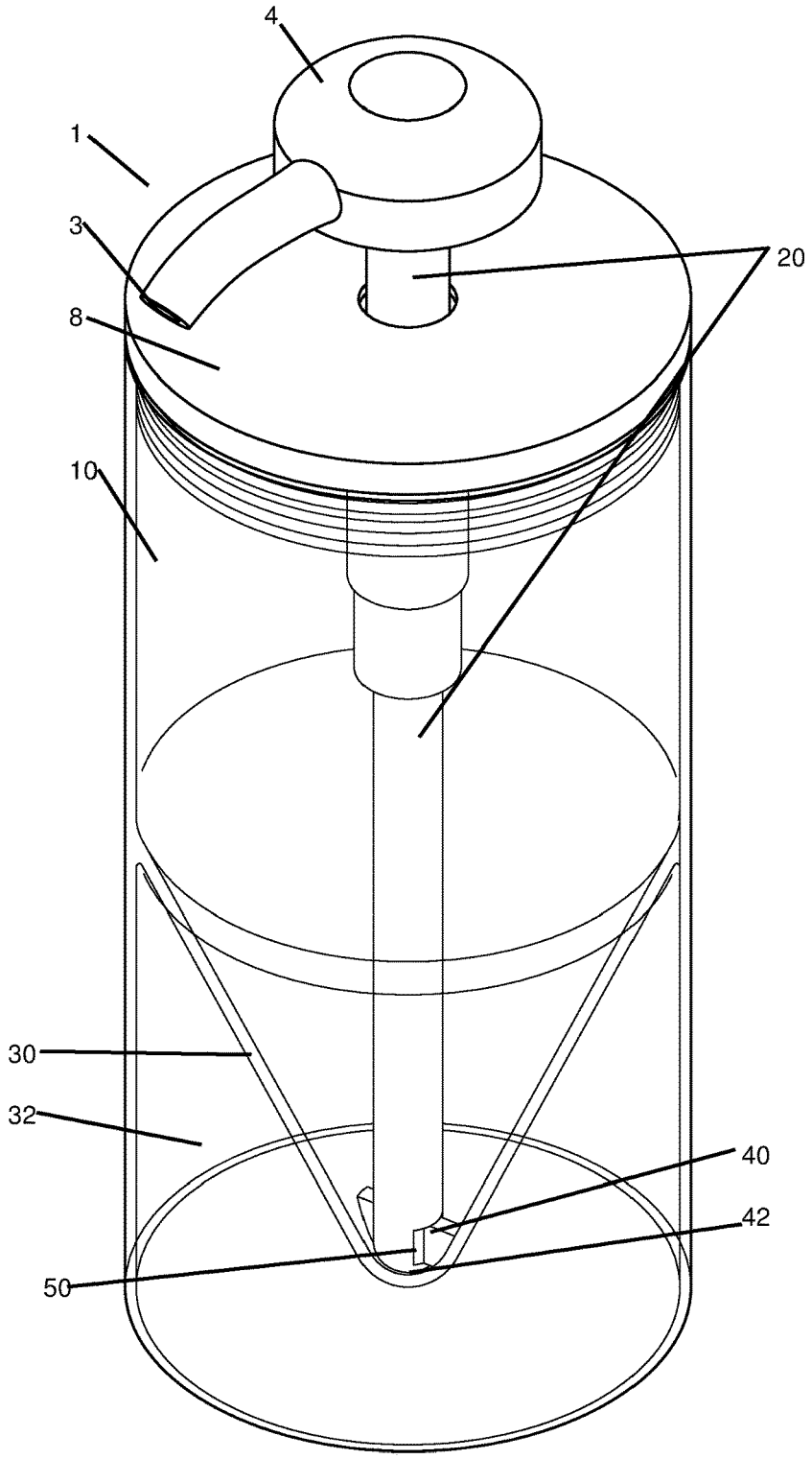
FIG. 2 shows a perspective view of the dispenser of FIG. 1.

Referring to FIGS. 1 and 2 simultaneously, FIG. 1 shows a cutaway elevation view of a dispenser of an embodiment of the disclosed technology. FIG. 2 shows a perspective view of the dispenser of FIG. 1. The dispenser 1 has a housing 10 which surrounds (on at least the top and sides) an internal space 12. Within the internal space 12, a liquid, solid, or combination thereof to be dispensed is held. A stem 20 extends into the internal space through a portal 6 at a top side 8 of the housing. The stem extends downwards through the internal space 12 until, in some embodiments, hitting the bottom thereof. Side portals 50 (see FIG. 4, for example) open into the stem 20.

A head or head unit 4 is outside of the housing 10 and joins with the stem 20. The stem has a longest direction extending vertically for purposes of this disclosure (see further directional definitions in the "summary"). The head 4 extends longitudinally or laterally further than that of the stem in embodiments of the disclosed technology. Further, a pathway for the liquid or solid extends from the internal space 12 of the housing 10 through the portals 50 at the bottom of the stem 20 and up and out through an internal pathway 2 of the head. A portal 3 at, for example, a lateral end of the head 4 opens into the internal pathway 2. The pathway 2 and interior of the stem 20 are functionally connected and the head 4 and stem 20 rotate together (in a clockwise and/or counter-clockwise direction when looking down at the stem from above).

Within the step 20 is, in some embodiments, a spring 22 which in a resting position pushes the head upwards. When the head is depressed (pressed downwards and/or towards the housing 10) this causes suction of the fluid and/or solid up through the stem 20, past a narrower lower spring blocking or holding mechanism 24, and ultimately out through the portal 3 of the head 4.

A bottom portion or region of the housing 10 can have a cone-shaped section 30. This cone-shaped, conical, or narrowing region 30 is defined as the bottom section of the housing 1. Above this bottom section is, in embodiments of the disclosed technology, a cylindrical section or section with equal or substantially equal (lateral) cross sections. The bottom conical section 30 has concentrically smaller and smaller cross-sections in embodiments of the disclosed technology. An external or exterior space 32 can be within the walls of the housing 10, but outside of the internal space 12. The external space 32 can be open at the bottom or closed/sealed and can be filled with solid material.

Figure 3:
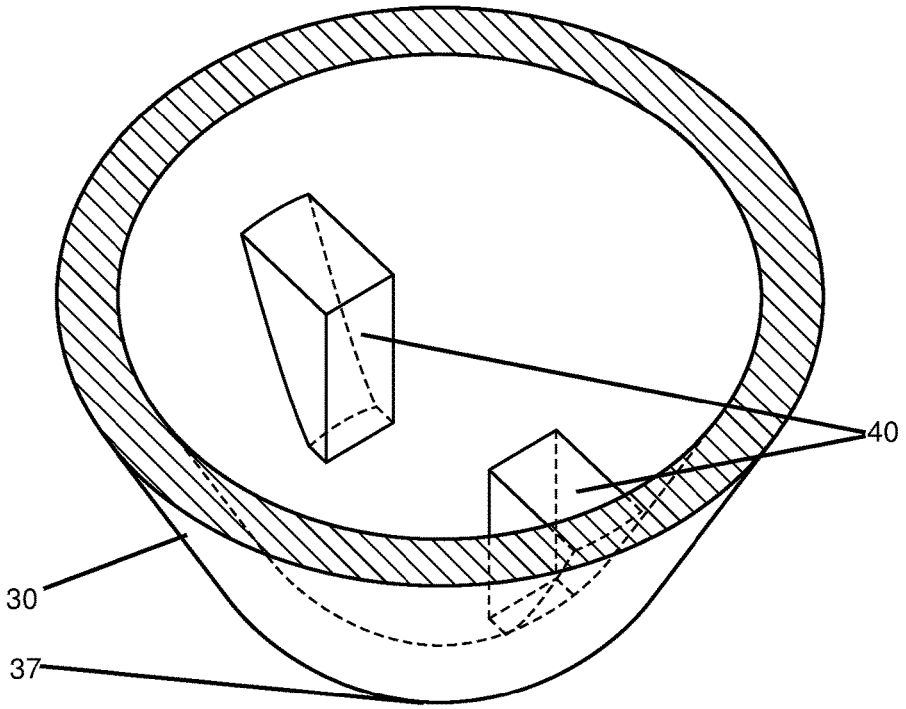
FIG. 3 shows a cutaway and perspective view of a bottom portion of the dispenser of FIG. 1.

FIG. 3 shows a cutaway and perspective view of a bottom portion of the dispenser of FIG. 1. The walls of the cone 30 are visible here, cut laterally. The walls are joined at a bottom side 37 and blocking flanges 40 are shown extending medially or inwards from the outer walls towards each other. The blocking flanges 40 can be formed as a unitary structure with the cone 30 are fixedly attached-thereto. A most medial vertical side can match the width and height, or be larger than one or both of the width and height, of the lateral portals 50 (see FIG. 5) of the stem. In this manner, the flanges 40 can block the portals 50 or one flange 40 can block a portal 50. The flanges 40 can have a vertical and flat, or vertical and curvilinear, medial (inner) side. This inner side, again, is sized in embodiments of the disclosed technology to block the side/lateral portals of the stem.

Figure 4:
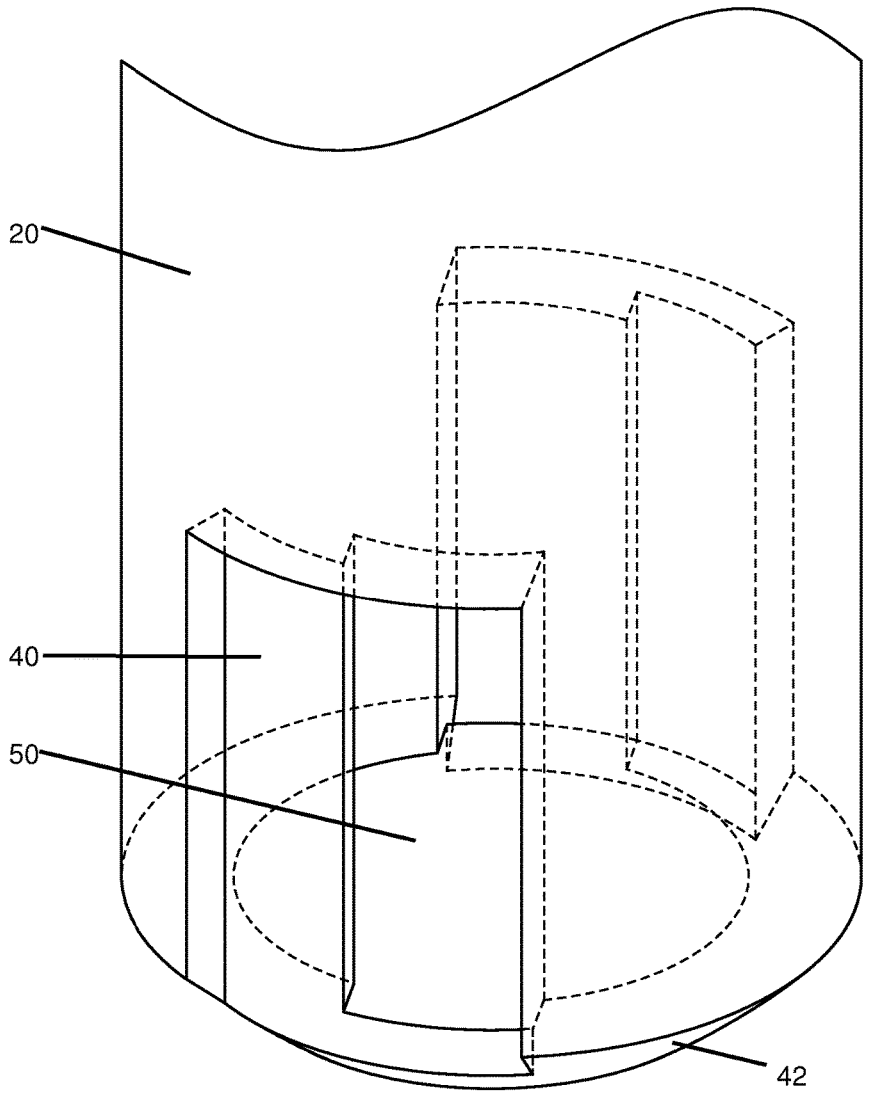
FIG. 4 shows a closeup of a portal and blocking flange of the dispenser of an embodiment of the disclosed technology.

FIG. 4 shows a closeup of a portal and blocking flange of the dispenser of an embodiment of the disclosed technology. The side walls of the stem 20 are shown extending to a closed bottom side 42. Note that in this embodiment, the blocking flange 40 is curvilinear at a medial side and matches the height of the portal 50 will be wider there-to. In this manner, the blocking flange 40 blocks opening 50 into the stem 20. Note that the portal 40 has a curved inner side matching that of the curved opening 50 of the stem 20.

Figure 5:
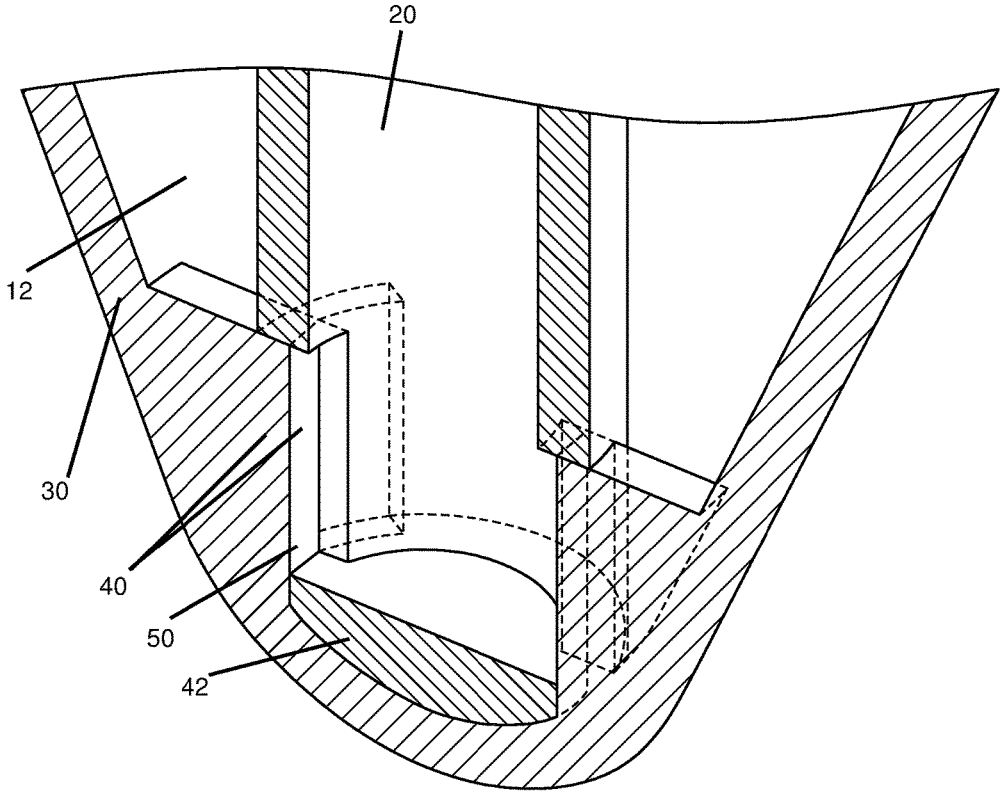
FIG. 5 shows a cutaway perspective view of a bottom portion of the dispenser of FIG. 3.

FIG. 5 shows a cutaway perspective view of a bottom portion of the dispenser of FIG. 3. Here, the inner space 12 meets the cone region 30 of the housing and the blocking flanges 40 extend inwards blocking the portal 50 of the step 20. The bottom side of the stem 42 is solid/closed and fits snugly and adjacent to an upper side of the bottom of the region 30. In this manner, the stem stays in place, held between the inward blocking flanges 40 so that the flanges can effectively block the portals 50, however, the stem 20 can rotate freely in an axial direction (e.g. lateral or "left/right" around in a circle). Thus, there is a snug fit, in embodiments of the disclosed technology, between the stem and top side of the bottom most part of the conical region 30 where "snug" is defined as "fitting together without noticeable cavities (to the naked eye) between two parts of devices which are fit as such." The blocking flanges 40 and portals 40 can also be snug fit with respect to one another.

Figure 6:
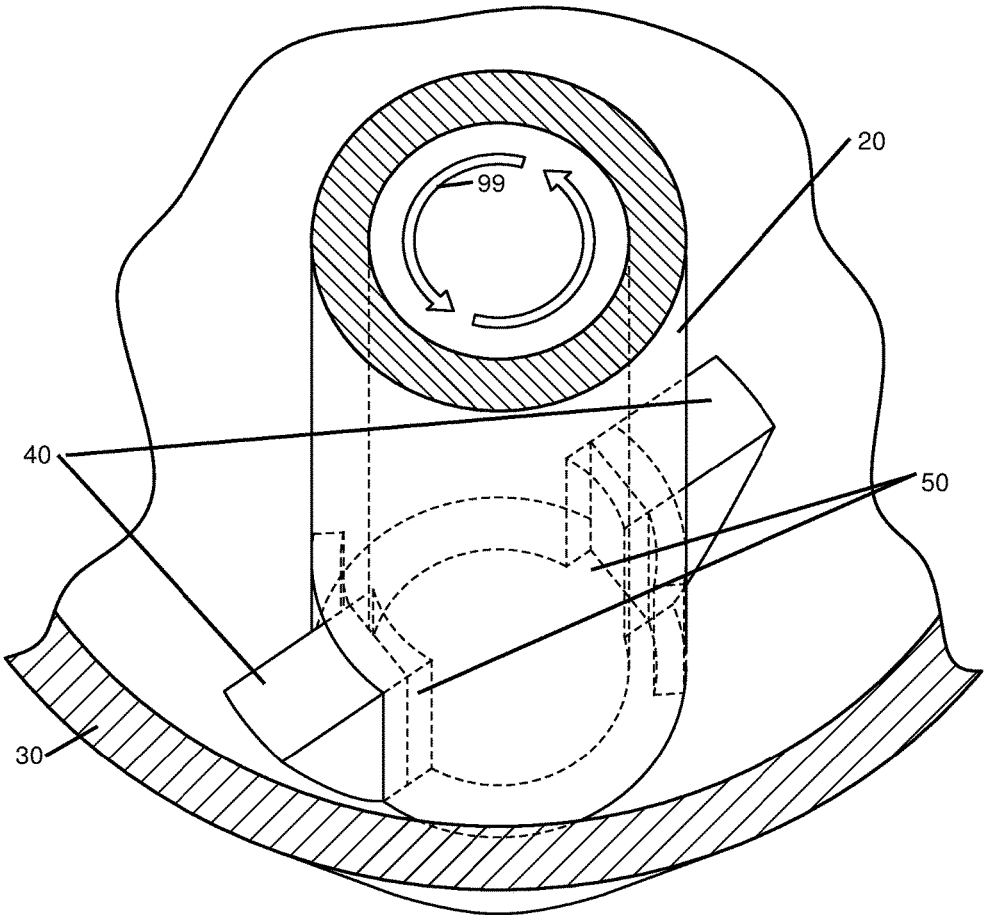
FIG. 6 shows a cutaway top and side perspective view of the bottom portion of the dispenser of FIG. 3 in a closed configuration.

FIG. 6 shows a cutaway top and side perspective view of the bottom portion of the dispenser of FIG. 3 in a closed configuration. Note that the blocking flanges 40 block the portals 50 into the stem 20. One can turn the stem in a direction 99 (clockwise or counter-clockwise) to move the portals 50 with respect to the blocking flanges 40.

Figure 7:
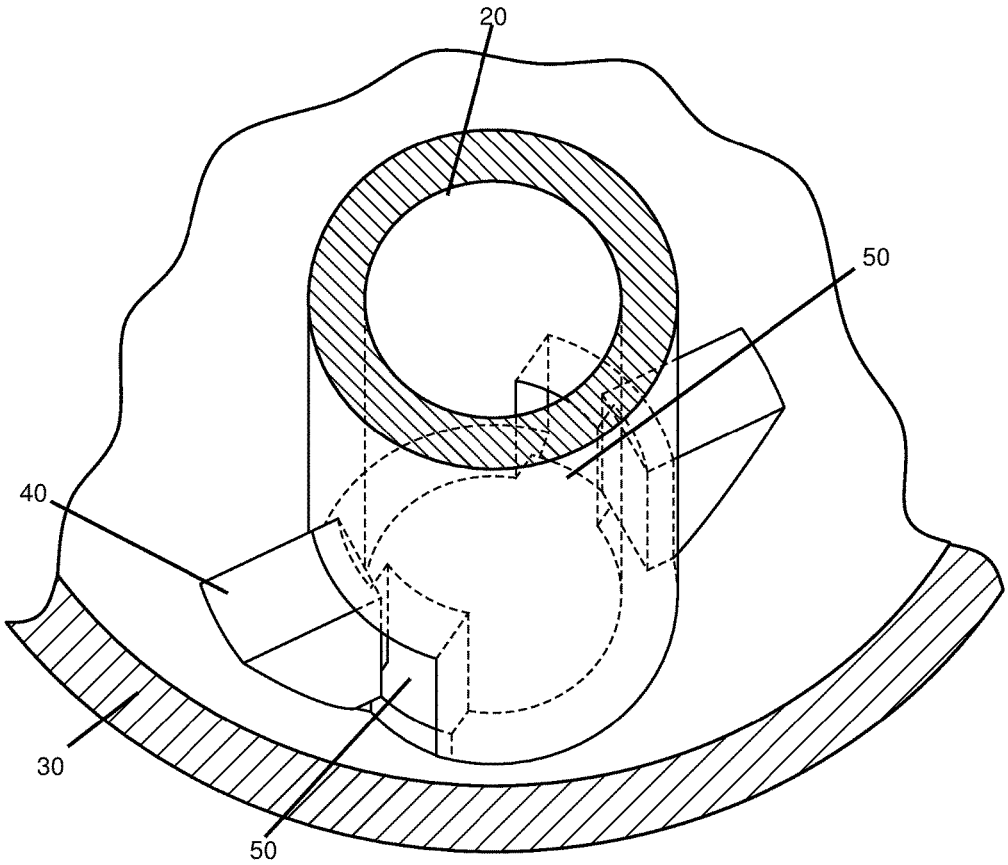
FIG. 7 shows a cutaway top and side perspective view of the bottom portion of the dispenser of FIG. 3 in an open configuration.

FIG. 7 shows a cutaway top and side perspective view of the bottom portion of the dispenser of FIG. 3 in an open configuration. Here, the blocking flanges 40 are offset axially/laterally from the portals 50 into the stem allowing liquid to flow upwards through the stem from the interior space 12 of the housing 10.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A dispenser, comprising:
- a dispensing pathway passing through a head and stem which rotate together;
- a housing having a top portal through which said stem passes into an interior space of said housing;
- a lateral portal cutting into a lateral side of said stem at a bottom end thereof;
- a blocking flange extending inward from said housing wherein:
  - at a first position of said head and stem, said blocking flange blocks said lateral portal;
  - at a second position of said head and stem which is axially rotated with respect to said first position, said lateral portal is open to said interior space of said housing.

2. The dispenser of claim 1, wherein said interior space is substantially made up of circular cross sections with a smaller circumference at a bottom side thereof compared to a top side thereof.

3. The dispenser of claim 2, wherein said interior space comprises a cylinder joined with a cone.

4. The dispenser of claim 3, wherein said blocking flange extends inward from said cylinder and has a vertical side wall which covers said lateral portal in said first position.

5. The dispenser of claim 4, comprising a second blocking flange on an opposite latitudinal side of said stem from said blocking flange and a second lateral portal on an opposite latitudinal side of said lateral portal.

6. A dispenser, comprising:
- a continuous internal space with a cylindrical region and a conical region;
- a stem extending through both said cylindrical region and said conical region, said stem fixedly attached to a head, said head situated outside of said continuous internal space; and
- said stem comprising:
  - a) at least one opening latitudinally aligned with said conical region; and
  - b) at least one opening which opens into an interior space of said head;
- wherein said head and stem are rotatable together and with respect to said continuous internal space; and
- wherein rotation of said stem with respect to said internal space blocks and/or unblocks said at least one opening aligned with said conical region.

7. The dispenser of claim 6, where at least one opening latitudinally aligned with said conical region is aligned substantially with a narrowest portion of said conical region.

8. The dispenser of claim 7, further comprising flanges extending from a bottom and said narrowest portion of said conical region which have a medial side sized to fit over said at least one opening latitudinally aligned with said conical region.

9. The dispenser of claim 8, wherein said at least one opening latitudinally aligned with said conical region is two openings on opposite longitudinal sides of said stem.

10. The dispenser of claim 9, wherein a bottom side of said stem is sealed.

11. A dispenser, comprising:
- a housing with internal space adapted for placement of particulate solid and/or liquid material;
- a stem extending through a top side of said housing and abutted to a bottom side of said housing;
- portals on either side of said stem adjacent to said bottom side of said housing;
- a head with an internal pathway, a portion of said internal pathway extending perpendicular to an internal pathway of said stem; and
- flanges fixedly connected to said housing and extending into said internal space sized to block said portals on said either side of said stem.

12. The dispenser of claim 11, wherein said stem and head are rotatable, as a unit, in a transverse direction to said stem; and
- said flanges block said portals in at least a first rotated position and said portals are open to said internal space in at least a second rotated position.

13. The dispenser of claim 12, wherein said internal space is progressively narrower along at least a portion of a height thereof with a narrowest width thereof being where said flanges are fixedly connected to said housing.

14. The dispenser of claim 13, wherein said internal space is substantially cone shaped at said progressively narrower portion thereof.

15. The dispenser of claim 11, wherein a pathway extends from an exterior of said dispenser through, in order, a transversely extending pathway in a head exterior to said housing, a vertical pathway in said stem, and said internal space with said flanges interrupting said pathway between said stem and said internal space when said head and said stem are rotated at a specific degree of rotation.

16. The dispenser of claim 11, wherein a bottom side of said stem is closed and fits within and between said flanges and a top side of said internal space in a snug manner.

* * * * *